US006601315B2

(12) United States Patent
Stafford

(10) Patent No.: US 6,601,315 B2
(45) Date of Patent: Aug. 5, 2003

(54) COMBINED FLUIDIZED BED DRYER AND ABSORPTION BED

(75) Inventor: Ulick Stafford, Wexford (IE)

(73) Assignee: Bausch & Lomb Incorporated, Rochester, NY (US)

( * ) Notice: Subject to any disclaimer, the term of this patent is extended or adjusted under 35 U.S.C. 154(b) by 0 days.

(21) Appl. No.: 09/737,003

(22) Filed: Dec. 14, 2000

(65) Prior Publication Data

US 2002/0073572 A1 Jun. 20, 2002

(51) Int. Cl.[7] ..... F26B 3/00; F26B 11/02

(52) U.S. Cl. ..... 34/80; 34/329; 34/330; 34/332; 34/333; 34/352; 34/360; 34/369; 34/505; 34/602

(58) Field of Search ..... 34/329, 330, 332, 34/333, DIG. 1, 340, 341, 343, 345, 352, 359, 360, 369, 417, 452, 472, 498, 499, 505, 138, 108, 126, 132, 597, 602, 80

(56) References Cited

U.S. PATENT DOCUMENTS

| | | | | | |
|---|---|---|---|---|---|
| 1,409,364 | A | * | 3/1922 | Dobbs et al. | 34/80 |
| 3,050,920 | A | * | 8/1962 | Norton | 34/80 |
| 3,793,740 | A | * | 2/1974 | Ganiaris | 34/10 |
| 3,889,388 | A | | 6/1975 | Oguri | 34/10 |
| 3,985,516 | A | * | 10/1976 | Johnson et al. | 44/1 R |
| 4,170,074 | A | | 10/1979 | Heckman | 34/57 A |
| 4,295,281 | A | | 10/1981 | Potter | 34/10 |
| 4,320,795 | A | * | 3/1982 | Gwyn et al. | 165/1 |
| 4,510,021 | A | | 4/1985 | Sowards | 201/4 |
| 4,535,065 | A | * | 8/1985 | Klein et al. | 502/21 |
| 4,637,837 | A | | 1/1987 | vonMatuschka | 148/6 |
| 4,974,337 | A | * | 12/1990 | Tavakoli et al. | 34/27 |
| 5,016,304 | A | * | 5/1991 | Ryhiner | 5/453 |
| 5,325,607 | A | | 7/1994 | Weib | 34/586 |
| 5,522,150 | A | * | 6/1996 | Schultz | 34/80 |
| 5,640,783 | A | * | 6/1997 | Schumaier | 34/219 |
| 5,650,063 | A | | 7/1997 | Yan | 208/305 |
| 5,697,976 | A | | 12/1997 | Chesterfield | 623/11 |
| 5,806,444 | A | | 9/1998 | Figueras | 110/346 |
| 5,852,879 | A | * | 12/1998 | Schumaier | 34/80 |
| 6,148,535 | A | * | 11/2000 | Porter | 34/80 |

FOREIGN PATENT DOCUMENTS

| | | | | |
|---|---|---|---|---|
| JP | 3-79982 | * | 4/1991 | F26B/5/16 |

* cited by examiner

*Primary Examiner*—Ira S. Lazarus
*Assistant Examiner*—K. B. Rinehart
(74) *Attorney, Agent, or Firm*—Katherine McGuire

(57) ABSTRACT

A combined fluidized bed dryer and absorption bed allows an absorbant to be dried to remove any moisture therefrom immediately followed by treating a product material with the dried absorbant, all in the same vessel, such that the absorbant is at its optimum dryness prior to treating the product material therewith The invention has particular application in the ophthalmic lens production where the absorbant is alumina and is used to remove methacrylic acid from liquid monomer prior to using the monomer in producing lenses.

14 Claims, 4 Drawing Sheets

COMBINED FLUIDIZED BED DRYER AND ABSORPTION BED

BACKGROUND OF THE INVENTION

The present invention relates to techniques for drying particulate matter in a fluidized bed process. More particularly, the present invention relates to an apparatus and method for drying a hygroscopic absorbant in a fluidized bed followed by treatment of a second material with the dried absorbant in the same vessel. The invention is yet more particularly directed to an apparatus and method for drying alumina in a fluidized bed and subsequently passing a monomer through the dried alumina for absorbing unwanted materials (e.g., methacrylic acid) from the monomer prior to using the monomer for manufacturing an ophthalmic lens such as a contact or intraocular lens.

Drying of particulate matter utilizing a fluidized bed process is known. See, for example, the following U.S. patents:

U.S. Pat. No. 3,889,388 issued to Takeda Chemical Industries, Ltd. On Jun. 17, 1975

U.S. Pat. No. 4,170,074 issued to Owens-Illinois, Inc. on Oct. 9, 1979.

In both the above patents, the apparatus for drying the particulate matter has no other purpose than to simply dry the particulate matter. Thus, once the particulate matter has been dried in the apparatus, the dried matter is removed from the apparatus for use in a separate processing station of the applicable manufacturing operation employed. In the '388 patent, the particulate matter is foodstuffs and the apparatus is directed toward drying and breaking up agglomerates of the particulate matter without harming the structure of the particles themselves. There is no discussion as to subsequent processing steps which utilize the dried particulate matter, however, since the particulate matter disclosed is foodstuffs, it is more than likely that the particulate matter is at least part of the final product of the manufacturing process (e.g., a vitamin tablet, see Col. 1, Ins. 1–24 therein).

In the '074 patent, the apparatus is similarly used for drying and breaking up of agglomerates of the particulate matter where the particulate matter is subsequently applied to a preheated work piece (e.g., glass bottle) via electrostatic application. Thus, the particulate matter being treated is also part of the finished product of the manufacturing operation.

In particular manufacturing operations, it is often necessary to use an absorbing agent to remove unwanted components from another material where the material being so treated is part of the final product of the manufacturing operation. For ease of description, the material being treated will be referred to as the "product material" and the absorbing agent will be referred to as simply as "absorbant" hereinafter, although it is understood that the invention is not limited to the type of materials being used with the present invention. The absorbant, which is by definition hygroscopic, will draw moisture from the environment when exposed thereto. Thus, if the manufacturing operation allows the absorbant to be exposed to the environment prior to it being used to treat the product material, the absorbant will not be at the most optimum dryness level at the time it is used to treat the product material. The prior art drying apparatus simply do not address this particular manufacturing process issue.

It would therefore be desirable to have an apparatus which dries the absorbant immediately prior to treating the product material with the absorbant. It would furthermore be beneficial to be able to both dry the absorbant and treat the product material in the same vessel. As such, the absorbant will be at its optimum dryness when used for treating the product material.

SUMMARY OF THE INVENTION

The present invention provides an apparatus and method for drying a particulate material that is used for treating a product material which has not heretofore been addressed in the prior art. The apparatus comprises a vessel into which a particulate absorbant is added for drying using a fluidized bed process where a dry gas (e.g., dry air or nitrogen) is delivered into the vessel from the bottom to create a fluidized bed of the absorbant which effectuates the drying process. Once the appropriate level of dryness is achieved and the absorbant has cooled, the product material is delivered into the vessel and forced through the dried absorbant material which removes unwanted components from the product material. The purified product material is then removed from the vessel through a conduit to a collection vessel located exteriorly of the drying vessel. In the most preferred embodiment, the vessel is kept airtight during the product material treatment stage to prevent any moisture from being reabsorbed into the absorbant. As such, the absorbant is at its most efficient dryness stage prior to treating the product material.

DETAILED DESCRIPTION

Figure 1:
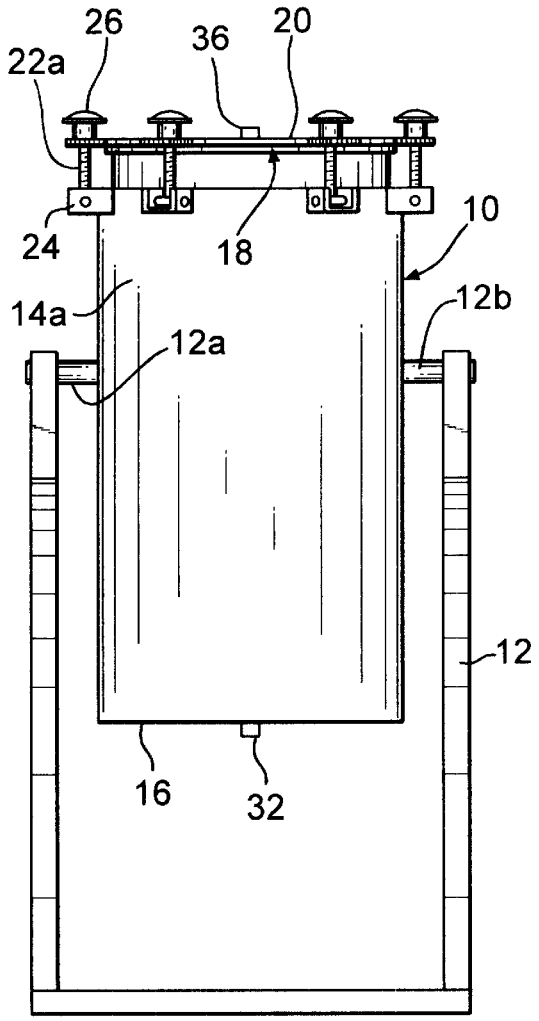
FIG. 1 is a front, elevational view of the apparatus of the invention.

Referring now to the drawing, there is seen in the Figures the apparatus and method of the invention comprising a drying vessel 10 which is capable of drying a quantity of particulate material in a fluidized bed, and thereafter treating a product material with the dried absorbant in the same vessel 10. The apparatus and method of the present invention is particularly useful for purifying a liquid monomer to be used in a contact or intraocular lens manufacturing operation, although it is understood that the invention may be used for any manufacturing process where the advantages of the invention as described herein may be realized. Thus, while the invention will be described herein as it pertains to ophthalmic lens manufacturing for the sake of description, the invention should not be considered limited to the ophthalmic lens art.

In the art of contact or intraocular lens manufacturing, a liquid lens material is used to form the finished lens using a variety of techniques (e.g., spin casting, lathing and cast molding), with the most common technique being static cast molding. In this method, the liquid lens material (referred to as "monomer" in the art), is dispensed into the female concave mold section of the mold and the male convex mold section is seated upon the female mold section to form a mold cavity wherein the monomer is cured to form the lens. Once the monomer has cured, the male mold section is lifted from the female mold section and the lens is retrieved from the mold. Further processing operations may be performed as necessary such as lens extraction (to remove volatiles and unreacted monomer therefrom), lens hydration, and lens sterilization and packaging for shipment to the consumer.

The liquid monomer may need to be pretreated (e.g., purified) prior to its discharge into the lens mold. For example, it has been found that the amount of methacrylic acid in a monomer should be kept to under about 40 ppm (parts per million) to form an acceptable lens. Should the monomer as received by the monomer manufacturer have a methacrylic acid content over about 40 ppm, the monomer needs to be treated with an absorbing agent to remove the excess quantity of methacrylic acid therefrom. A common absorbing agent used for this purpose is alumina, a granular, hygroscopic material. Since the alumina is hygroscopic, exposure to the ambient will result in the alumina absorbing moisture from the ambient. Should the alumina have a high moisture content, the extraction efficiency thereof may be compromised, and the moisture in the alumina may furthermore be desorbed and transferred to the monomer during the treatment thereof which can cause further downstream processing problems. For example, excess water content in the monomer may interfere with the performance of the vacuum pump used when subsequently distilling the monomer. Distilling the monomer is often necessary to further purify the monomer by removing heavier contaminants therefrom such as diethylglycolmethacrylate, for example. The present invention eliminates the problem of excess water being transferred from the alumina to the monomer by providing a drying vessel 10 wherein the alumina may be both dried and subsequently used to treat the monomer, all in the same vessel such that the alumina is at its most optimum dryness when the monomer is treated therewith.

Vessel 10 may be of any material and configuration for containing a quantity of particulate matter therein. In the preferred embodiment, vessel 10 is formed from an inert material which will not react with the intended contents of vessel 10. In the example provided herein, the metal chosen is a stainless steel (which is non-reactive with the monomer and alumina) in the configuration of a drum having an outer cylindrical side wall 14*a*, a bottom wall 16, and an open top 18. An inner cylindrical side wall 14*b* may be provided spaced from outer side wall 14*a* with an insulated material 11 therebetween (FIGS. 4–7). A vessel cover 20 is provided which may be removably secured to the open top 18 of vessel 10 by any appropriate securing means such as, for example, a plurality of bolts 22*a* each pivotally secured at a first end 22*b* thereof to a respective bracket 24 fixed to outer side wall 14*a* adjacent open top 18. Each bolt 22*a* may be pivoted to align with and extend up through a respective hole 20*a* formed in cover 20. A respective number of lug nuts 26 are secured to the free end 22*c* of a respective bolt 22*a* (see FIG. 6) to create a hermetically sealed container.

Figure 2:
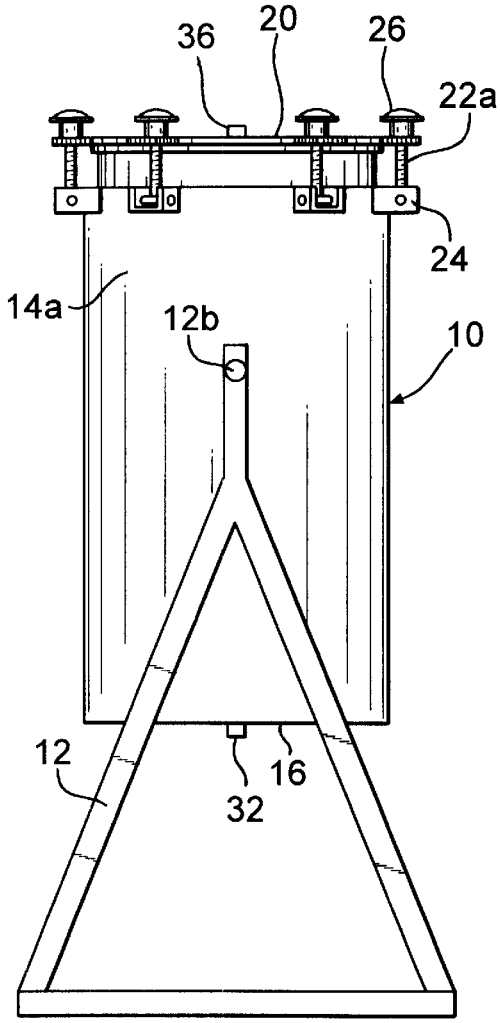
FIG. 2 is a side elevational view thereof.
Figure 3:
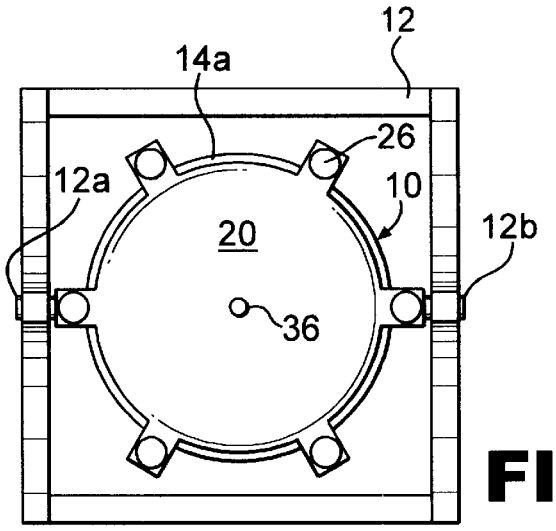
FIG. 3 is a top plan view thereof.
Figure 4:
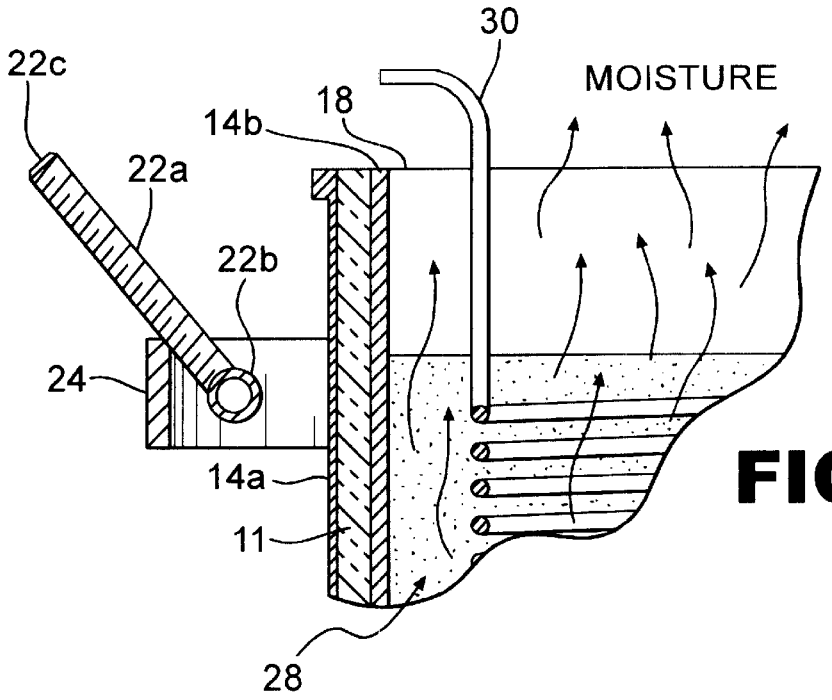
FIG. 4 is a cross-sectional, fragmented view of the drying vessel at the upper end thereof.
Figure 5:
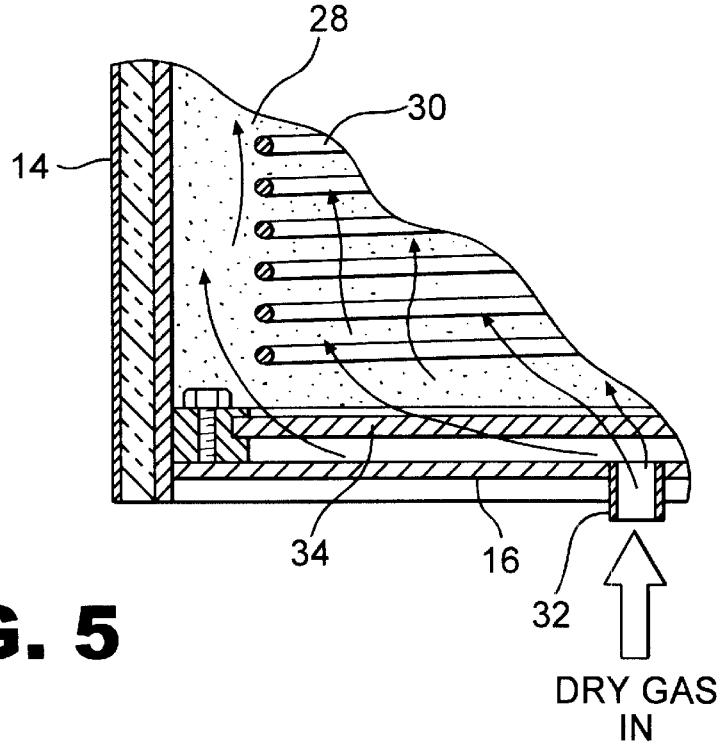
FIG. 5 is a cross-sectional, fragmented view of the drying vessel at the lower end thereof.
Figure 8:
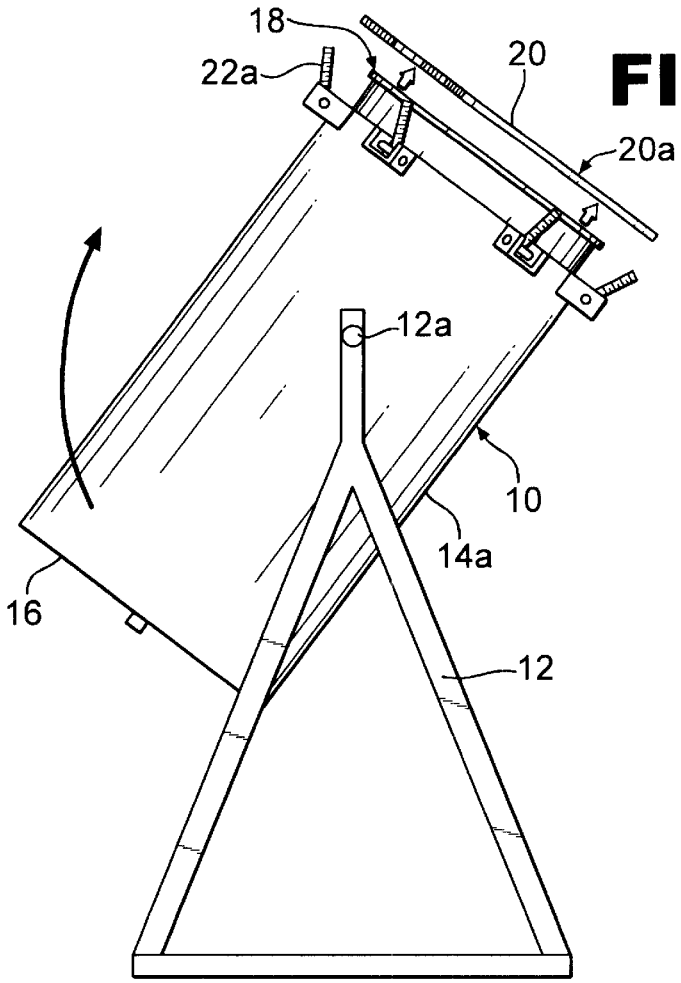
FIG. 8 is the view of FIG. 2 except showing the cover plate removed from the open top of the vessel, arid the vessel being rotated about its base.
Figure 9:
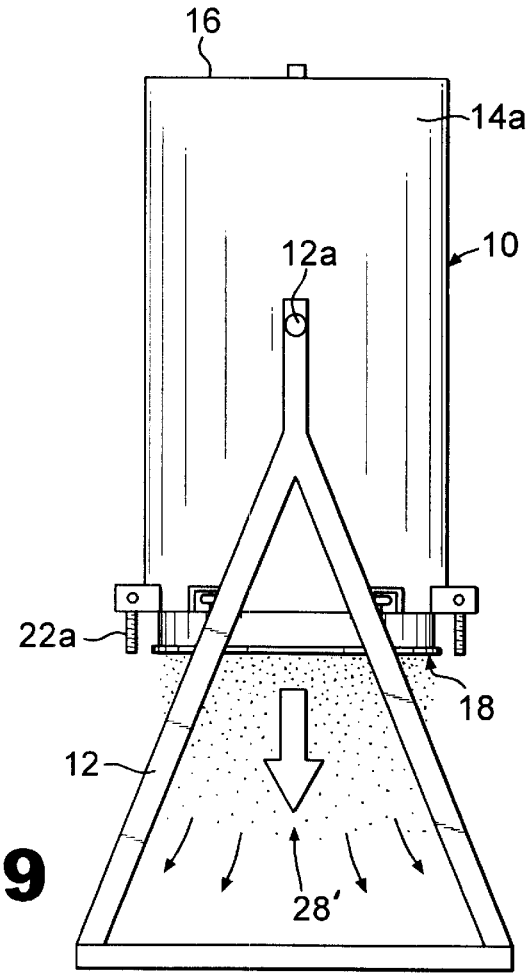
FIG. 9 is the view of FIG. 8 except showing the vessel completely inverted for removal of the spent absorbant from the vessel.

Vessel 10 may be pivotally attached to stand 12 via pole segments 12*a* and 12*b* such that vessel 10 may be inverted from the upright position seen in FIGS. 1 and 2, to the tilted and then completely inverted positions seen in FIGS. 8 and 9, respectively, to be able to easily dump the contents of vessel 10 as needed.

There are two main steps in utilizing the invention herein; the first being to dry the alumina, and the second being to force the monomer through the dried alumina to extract unwanted components from the monomer. Thus, with cover 20 removed from vessel 10, a quantity of alumina 28 is delivered into vessel 10 together with a removable heating element 30 which preferably is of the coiled, resistance type. To create a fluidized bed of the alumina, a dry gas is delivered through port 32 which extends through vessel bottom wall 16 to the interior of vessel 10. A porous plate 34 is suspended slightly above bottom wall 16 inside vessel 10 upon which the alumina may be supported. The porous plate 34 allows the gas to travel therethrough and disperse upwardly into vessel 10, thereby creating forces which circulate the particles of alumina on and above plate 34 within the interior space of vessel 10. During this process, the alumina resembles a boiling liquid and behaves as a fluid. As such, this is known as a fluidized bed process in the art.

It is noted that during the gas flow process, cover 20 is not attached to open top 18 so that evaporating moisture may exit the vessel. To prevent the alumina from being propelled out of the vessel, the gas flow into the vessel should be kept at a level to prevent this from occurring. If desired, a mesh cover (not shown) could be placed over open top 18 during this process to keep the alumina from exiting the vessel while allowing the evaporated moisture to escape. The mesh cover should be chemically inert and able to withstand elevated temperatures, an example being a 200 threads per inch stainless steel mesh.

The combination of the gas and the heating element 30 act to remove moisture from the alumina so that it is at its optimum dryness when treating the monomer. While the dry gas is capable to dry the alumina to the desired level of dryness, the use of heating element 30 in combination therewith is more efficient since it accelerates the drying process and its use is therefore preferred.

It is noted that the alumina should not be heated above the point where it will begin to melt and form agglomerates. It has been found that an interior vessel temperature of about 300° C. for a duration about two hours is sufficient to dry about ten kilograms of alumina at a time. These processing parameters will of course need to be adjusted according to the particular process being employed with the invention which is within the scope of those skilled in the art.

Figure 6:
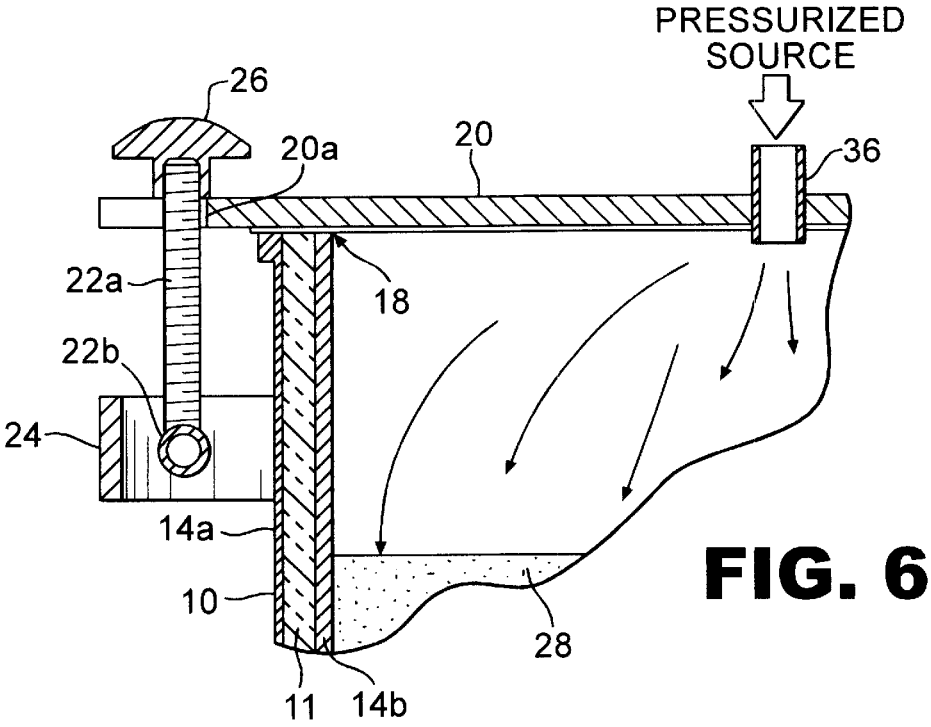
FIG. 6 is the view of FIG. 4 except showing the cover plate attached to the vessel's open top.
Figure 7:
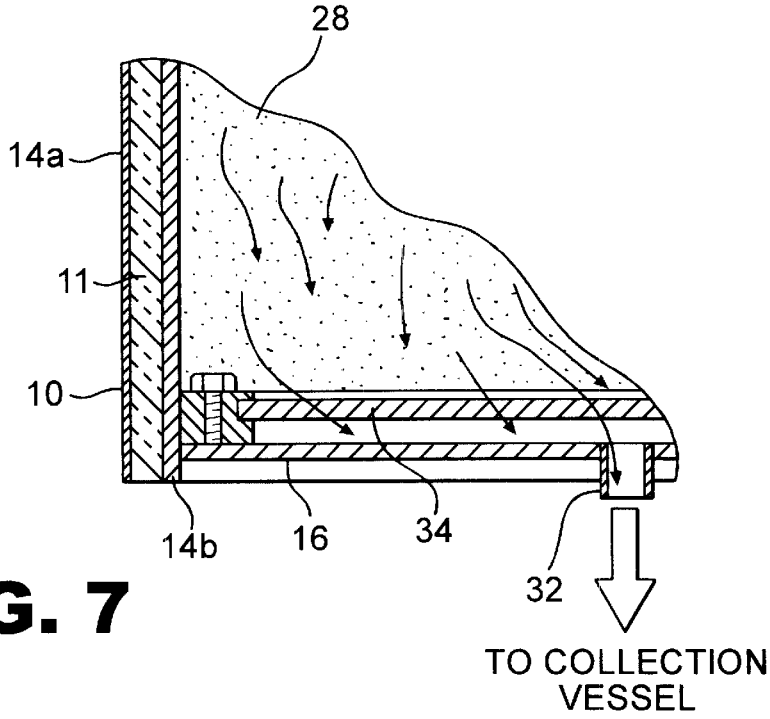
FIG. 7 is the view of FIG. 5 except showing the heating element removed from the vessel and the product material being passed through the dried absorbant.

Thus, once the alumina has been adequately dried as described above, the heating element 30 is turned off and the alumina is allowed to cool. If desired, cooling of the alumina can be accelerated by continuing the delivery of the cooler gas through port 32 until the alumina cools to the desired temperature. Once the alumina has cooled to the desired temperature and heating element 30 has been removed from vessel 10, cover 20 is quickly placed upon vessel open top 18 so that the alumina is exposed to the ambient for the least possible amount of time. As such, the alumina will not have a chance to reabsorb moisture from the ambient in any appreciable amount. Cover 20 is also provided with an inlet port 36 whereon a conduit is attached to deliver a source of monomer (not shown) into vessel 10 at a predetermined flow rate. At this time, the dry gas source is removed from port 32 in bottom wall 16 and a monomer collection vessel is attached via conduit thereto (the collection vessel and conduit are not shown). The monomer is then delivered under pressure through top port 36 into vessel 10 whereupon the monomer travels downwardly through the bed of dried alumina 28, through porous plate 34 and out bottom port 32 to the purified monomer collection vessel, as seen in FIGS. 6 and 7.

It will be appreciated that during the drying stage, the porous plate 34 serves to both support the bed of alumina within vessel 10 while also allowing the dry gas to permeate therethough from beneath. It will also be appreciated that during the monomer treatment stage, the porous plate 34 serves to again support the alumina while allowing the monomer to pass through the porous plate 34 without letting the alumina also pass therethrough. The construction of porous plate 34 is therefore specific to this particular application of the invention. In the specific example of materials used with the invention provided herein, the porous plate 34 is constructed of 3 mm thick 316L sintered stainless steel having a grade of S40 and having a minimum porosity of about 43% and a maximum porosity of about 50%. It is understood, however, that other materials could be used for porous plate 34 so long as it has the ability to support the absorbant bed while allowing gas to permeate therethrough to fluidize the bed, and also the ability to allow the product material to pass therethrough while not allowing the absorbant to pass therethrough.

Once the alumina has reached its absorption limit, the spent alumina is removed from vessel 10 and replaced with new alumina. This process is simplified by the pivotal attachment of vessel 10 to stand 12 where cover 20 is removed, and vessel 10 is rotated about stand 12 as seen in FIGS. 8 and 9 to dump the spent alumina 28'. Thereafter, the vessel 10 is rotated back to its upright position, and a fresh quantity of alumina is delivered into vessel 10 to repeat the drying and monomer purification process described above.

What is claimed is:

1. A method for drying an absorbant material and subsequently treating a product material with the dried absorbant material, said method comprising the steps of:

a) providing a vessel having an outer side wall, a bottom wall and an open top with a removable cover for closing said open top;

b) delivering a quantity of said absorbant into said vessel through said open top;

c) delivering a flow of dry gas into said vessel to create a fluidized bed of said absorbant in said vessel, said dry gas being delivered into said vessel for a period of time sufficient for said absorbant to reach a predetermined level of dryness;

d) stopping the flow of gas into said vessel after said predetermined level of dryness has been reached;

e) placing said cover on said vessel open top to create a substantially air-tight vessel; and f) forcing a quantity of said product material into said vessel, through said absorbant, and out of said vessel.

2. The method of claim 1, and further comprising the step of heating said absorbant simultaneous with delivery of said gas into said vessel.

3. The method of claim 2 wherein said heating is provided by a heating element removably placed in said vessel.

4. The method of claim 3, wherein upon said absorbant reaching a predetermined level of dryness, said heating element is turned off.

5. The method of claim 4, wherein delivery of said dry gas into said vessel is continued to cool said absorbant to a predetermined temperature after said heating element has been turned off.

6. The method of claim 1, wherein said product material is monomer and said absorbant is alumina, and wherein said alumina acts to remove methacrylic acid from said monomer when said monomer is passed through said alumina.

7. The method of claim 1, and further comprising the step of placing a porous plate in said vessel for supporting said absorbant in said vessel, said porous plate operable to allow said dry gas and said product material to pass therethrough while preventing said absorbant from passing therethrough.

8. Apparatus for drying a first material with a source of dry gas and thereafter treating a product material, different from said first material, with said first material, said apparatus comprising:

a) a vessel having a wall defining an interior with first and second ports providing fluid access to said vessel interior;

b) a porous plate positioned within said vessel interior and upon which a quantity of said first material may be deposited and supported thereby, said porous plate having a porosity sufficient to enable passage of said dry gas and said product material therethrough yet prevent passage of said first material therethrough;

c) a cover for hermetically sealing said vessel prior to delivery of said product material therein;

d) a stand upon which said vessel is pivotally mounted to enable selective inversion of said vessel with respect to said stand:

whereby a source of dry gas is deliverable through said first port, through said porous plate and through said first material to create a fluidized bed of said first material within said vessel interior and thereby dry said first material, and thereafter a quantity of said product material is deliverable under pressure through said second port, through said dry first material, through said porous plate, and exit said vessel through said first port.

9. The apparatus of claim 8, wherein said vessel comprises an outer cylindrical wall, a bottom wall, and an open top upon which said cover may be removably sealed, said first port being formed in said bottom wall and said second port being formed in said cover.

10. The apparatus of claim 9 wherein said porous plate is positioned in a spaced, parallel plane with respect to said vessel bottom wall.

11. The apparatus of claim 9, and further comprising a mesh cover for placing over said open top during drying of said first material.

12. The apparatus of claim 8, and further comprising a heating element for removably positioning in said vessel interior with said first material during delivery of said dry gas through said first port and into said vessel.

13. The apparatus of claim 8, wherein said first material is alumina, and said product material is monomer.

14. The apparatus of claim 8 wherein said porous plate is formed of sintered stainless steel.

* * * * *